US006227868B1

(12) United States Patent
Wlodarski

(10) Patent No.: US 6,227,868 B1
(45) Date of Patent: May 8, 2001

(54) COAXIAL CABLE CONNECTOR

(76) Inventor: Antoine Wlodarski, 6500, rue Léon Derome, Montréal (CA), H1M 1S4

( * ) Notice: Subject to any disclaimer, the term of this patent is extended or adjusted under 35 U.S.C. 154(b) by 0 days.

(21) Appl. No.: 09/565,456

(22) Filed: May 5, 2000

(51) Int. Cl.[7] ..... H01R 12/00
(52) U.S. Cl. ..... 439/63; 439/638
(58) Field of Search ..... 439/63, 944, 628, 439/578, 584, 638, 654

(56) References Cited

U.S. PATENT DOCUMENTS

| | | | | |
|---|---|---|---|---|
| 4,533,187 | | 8/1985 | Kirkman | 439/83 |
| 4,925,403 | * | 5/1990 | Zorzy | 439/578 |
| 5,498,175 | | 3/1996 | Yeh et al. | 439/578 |
| 5,667,409 | | 9/1997 | Wong et al. | 439/654 |
| 5,863,220 | * | 1/1999 | Holliday | 439/584 |
| 5,863,226 | * | 1/1999 | Lan et al. | 439/852 |
| 5,865,654 | | 2/1999 | Shimirak et al. | 439/852 |
| 5,993,254 | | 11/1999 | Ptschi et al. | 439/584 |

* cited by examiner

*Primary Examiner*—Tulsidas Patel

(57) ABSTRACT

The present invention concerns an electrical connector for a coaxial cable with an effective contact member made out of high electrically conductive material. The electrical connector comprises a conductive main body with an inner passage and two insulating sleeves, each provided with a small diameter section. The contact member is fitted in the small diameter sections and the inner passage of the electrical connector and is provided with two hollowed cylindrical ends with a central section therebetween. Each end is adapted to be axially slidably engaged by a center conductor of a coaxial cable and is provided with two simple equally spaced and radially opposed rectangular openings, creating two equally spaced and radially opposed contact portions continuous beams therebetween. The axially elongated contact portions have two tangentially cambered surfaces inwardly incurved beams have a concave inner surface and are inwardly cambered to define apex contact regions. Each beam is resilient and adapted for biasing the center conductor against the contact region of the other beam. The beams are adapted to flatten out at the contact region against the center conductor to provide axial linear contacts with the latter.

10 Claims, 3 Drawing Sheets

COAXIAL CABLE CONNECTOR

FIELD OF THE INVENTION

The present invention relates to coaxial cable connectors, and more specifically to a connector with an end section of substantially tubular shape contact member having physical deformations adapted to slidably receive a coaxial wire.

BACKGROUND OF THE INVENTION

Electrical connecting devices are commonly used in today's industry. Connections need to be inserted in many sections of a particular electrical network for all types of reasons. Because of their increased usage in high frequency power, the connecting devices need to be more efficient to carry signals, have good impedance characteristics and be easy to install and remove with minimum loss of time and no physical damages to the connecting device itself or to the other components being connected or disconnected, and reliable in terms of electrical conducting efficiency.

Dual beam connector has been disclosed in the prior art in U.S. Pat. No. 4,533,187 issued on Aug. 6, 1985 to Kirkman. The connector has contacts having opposing reverse-bend contact arms which gives an increased soldering reliability. However, in this invention intended mainly for printed circuit board the end of the device is relatively large. It will be noted also that no real planar contact can exist, and that the contact pin is not axially directed towards the device. Furthermore, it is not specified that the extremities of the contact arms are not touching, potentially causing damage to the pin when it is removed.

Prior art of various but similar structure improvements for connectors of coaxial cable have been disclosed in U.S. Pat. No. 5,667,409 and U.S. Pat. No. 5,863,226 issued on Sep. 16, 1997 and Jan. 26, 1999 respectively to Wong et al. and Lan et al. respectively. These patents basically have at each end of the contact component two holes with the tab material of the holes inwardly pushed (not removed) forming at each end a pair of inclined planes extending toward the interior of the tube. One of these inventions also furthermore has two narrow slits at each end of the contact member. However, although the surface of the contact between a wire and the contact member may be increased, it will still generally remain on an axially oriented line, rather than on a plane; this undesired resulting effect is caused by the fact that one end of each inclined plane is free. Furthermore, if a large wire is used, the effectiveness of the connector could suffer with the subsequent used wires, especially if they are smaller, since after many utilization the material of the holes inwardly pushed could have been deformed by the large size wire. Oppositely, if the closing spring action of the pair of inclined planes is too strong, damages could be sustained by the wire upon removal, once again because of the small surface in contact.

In coaxial cable connector as disclosed in U.S. Pat. No. 5,865,654 issued on Feb. 2, 1999 to Shimirak et al., the contact member has a spring-tab with one fixed and one free ends. As in the other inventions mentioned earlier, because of the free end of the spring-tab, the contact between the tab and the wire of the cable may not be a symmetrical and circumferential planar one. Furthermore in this case, the wire and the connecting member will not be on a same axis, maybe damaging and deforming the engaging wire or pin.

Also, this type of spring-tab shape is not easily obtained and requires expensive cutting and forming processes.

OBJECTS OF THE INVENTION

It is therefore a general object of the present invention to provide a coaxial cable connector of the character described which obviates the above noted disadvantages.

Another object of the present invention is to provide a coaxial cable connector that provides a large effective contact zone between the contact member and a wire, or a pin, with a wide range of diameters.

Another object of the present invention is to provide a coaxial cable connector that keeps a connecting wire in the same axis as the connector.

A further object of the present invention is to provide a coaxial cable connector that provides for an easy, smooth and non-damaging guiding insertion, a strong and non-damaging retaining force, and a smooth and non-damaging removal of a wire within or from the coaxial cable connector.

Still another object of the present invention is to provide a coaxial cable connector that has a contact member on which a plating or a coating can easily be applied both on the inside and on the outside tubular section, especially at the wire contacting area.

Another object of the present invention is to provide a coaxial cable connector that has outstanding mechanical characteristics to minimize electrical perturbations of transmitted signals.

Further objects and advantages of the invention will be in part obvious from an inspection of the accompanying drawings and a careful consideration of the following description.

SUMMARY OF THE INVENTION

The present invention consists of an electrical connector comprising:

- a main body made out of an electrically conductive material and having an inner passage therethrough;
- a pair of insulating sleeves fitted inside said inner passage, an outer end face of each insulating sleeve include a small diameter section; and
- a cylindrical contact member made out of an electrically conductive material and being fitted between said small diameter sections of said insulating sleeves, said cylindrical contact member having a first and second ends with a central section therebetween, said first end of said contact member is substantially tubular and is adapted to be axially slidably engaged by a center conductor, said first end includes two equally spaced radially opposed and axially elongated continuous beams forming two adjacent equally spaced radially opposed holes therebetween each of said beams having a concave inner surface and being substantially symmetrically, radially, inwardly cambered towards the axis of said contact member to define an apex contact region, both of said contact regions forming an axially transverse and partially closed opening defined by both of said inner surfaces to receive said center conductor, each of said beams being resilient and adapted for biasing said center conductor against said contact region of the other of said beams, said beams being adapted to flatten out at said contact regions against said center conductor thereby providing axial linear contacts with the latter.

Preferably, the second end of said contact member is also substantially tubular and is adapted to be axially slidably engaged by a second center conductor, said second end includes two second equally spaced radially opposed and axially elongated continuous beams forming two adjacent second equally spaced radially opposed holes therebetween, each of said second beams having a second concave inner surface and being substantially symmetrically, radially, inwardly cambered towards the axis of said contact member to define a second apex contact region, both of said second contact regions forming an axially transverse and partially closed second opening defined by both of said second inner surfaces to receive said second center conductor, each of said second beams being resilient and adapted for biasing said second center conductor against said second contact region of the other of said second beams, said second beams being adapted to flatten out at said second contact regions against said second center conductor thereby providing second axial linear contacts with the latter.

Alternatively, the second end of said contact member may be of substantially cylindrical shape, said second end of said contact member having a diameter smaller than said central section of said contact member.

Preferably, each of said smaller diameter sections of said insulating sleeves includes a bore hole adapted to sealably receive one of said ends of said contact member.

Preferably, the first and second ends of said contact member have their respective beams axially aligned with respect to each other.

Alternatively, the first and second ends of said contact member may have their respective beams axially rotated 90 degrees with respect to each other.

Preferably, the central section is substantially cylindrical and solid.

Alternatively, the central section may be substantially cylindrical and hollowed.

BRIEF DESCRIPTION OF THE DRAWINGS

In the annexed drawings, like reference characters indicate like elements throughout.

DETAILED DESCRIPTION OF THE PREFERRED EMBODIMENTS

Figure 1:
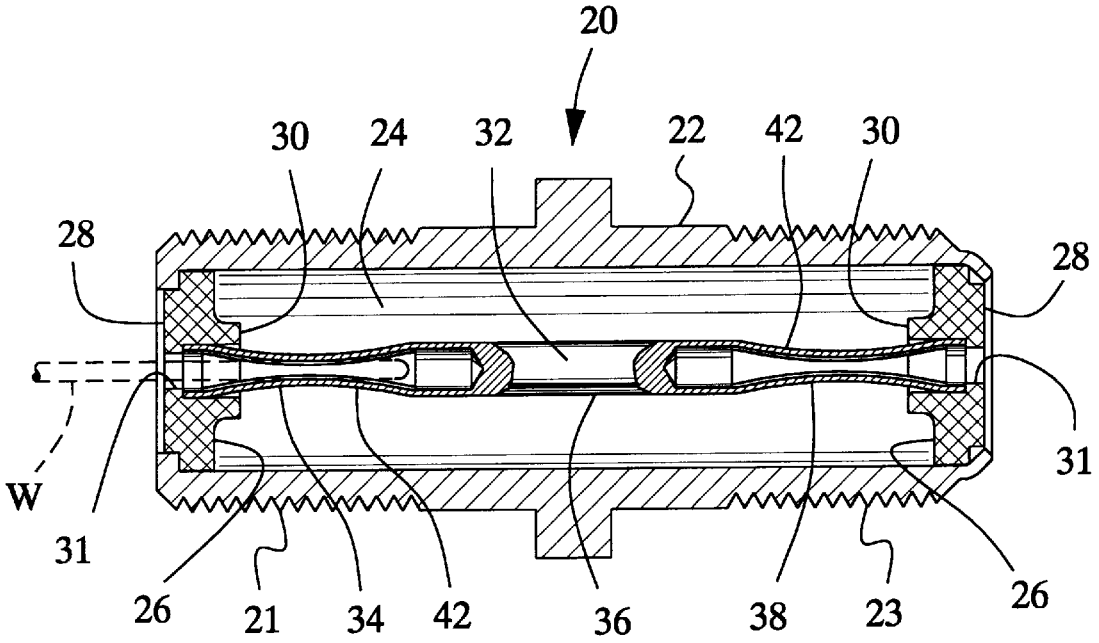
FIGS. 1 and 1*a* are section views of a first and second embodiments of a female-female and male-female types of coaxial electrical cable connector of the present invention respectively.

Referring to FIG. 1, there is shown a first embodiment of an electrical connector, preferably a coaxial cable connector 20 according to the present invention, and comprising a main body 22 made out of an electrically conductive material and having an inner passage 24 therethrough, and a pair of insulating sleeves 26 fitted inside the inner passage 24 at each end 21, 23 thereof. The exposed area on each insulating sleeve 26 at each end 21, 23 of the main body 22 is an outer end face 28 that sealably closes its respective end 21, 23 of the connector 20. A small diameter section 30 is provided in the center of each insulating sleeve 26, and includes an inwardly axial bore hole 31. A generally cylindrical contact member 32 is fitted between the two small diameter sections 30 of each insulating sleeves 26. The contact member 32 is then axially centered in the inner passage 24 of the main body 22 of the electrical connector 20 and is made out of a preferably high electrically conductive material. The machining of the outside of the main body 22 of the electrical connector 20 to preferably screwably engage typical coaxial connectors is well known to anyone skilled in the art and will not be described herein.

Figure 1A:
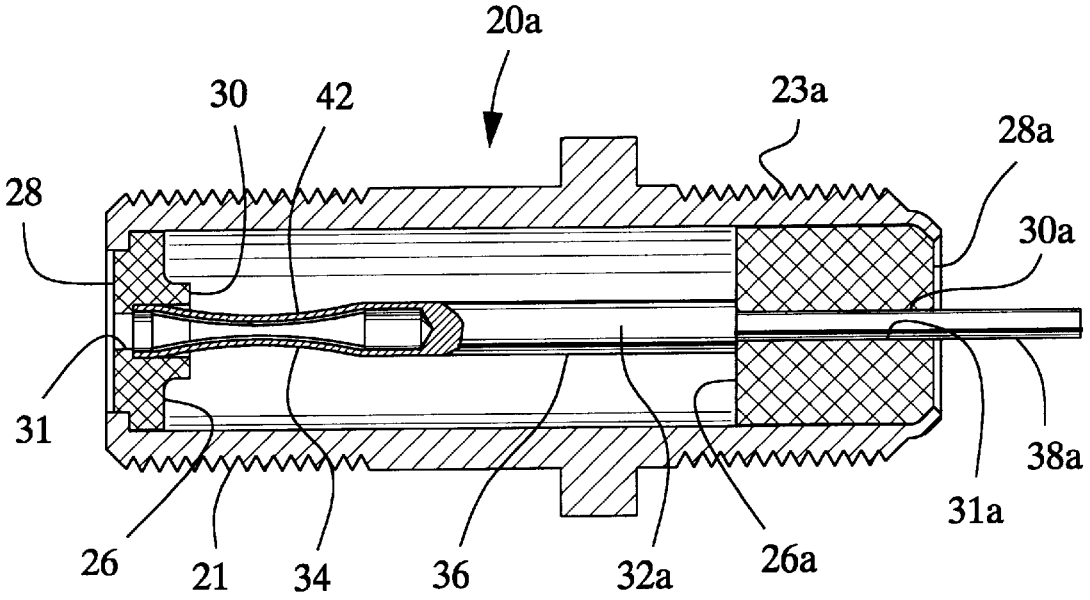

FIG. 1*a* shows a second embodiment of a coaxial cable connector 20*a* similar to the one presented in FIG. 1. All elements comprised in the first end 21 of the electrical connector 20*a* are similar with all elements in the first end 21 of the electrical connector 20 while some elements in the second end 23*a* of the electrical connector 20*a,* such as the second insulating sleeve 26*a* and the through hole 31*a,* are adapted for a different second end 38*a* (FIG. 2*a*) of the contact member 32*a* (also shown on FIG. 2*a* for details) as opposed to the second end 23 adapted for the second end 38 of the contact member 32.

Figure 2:
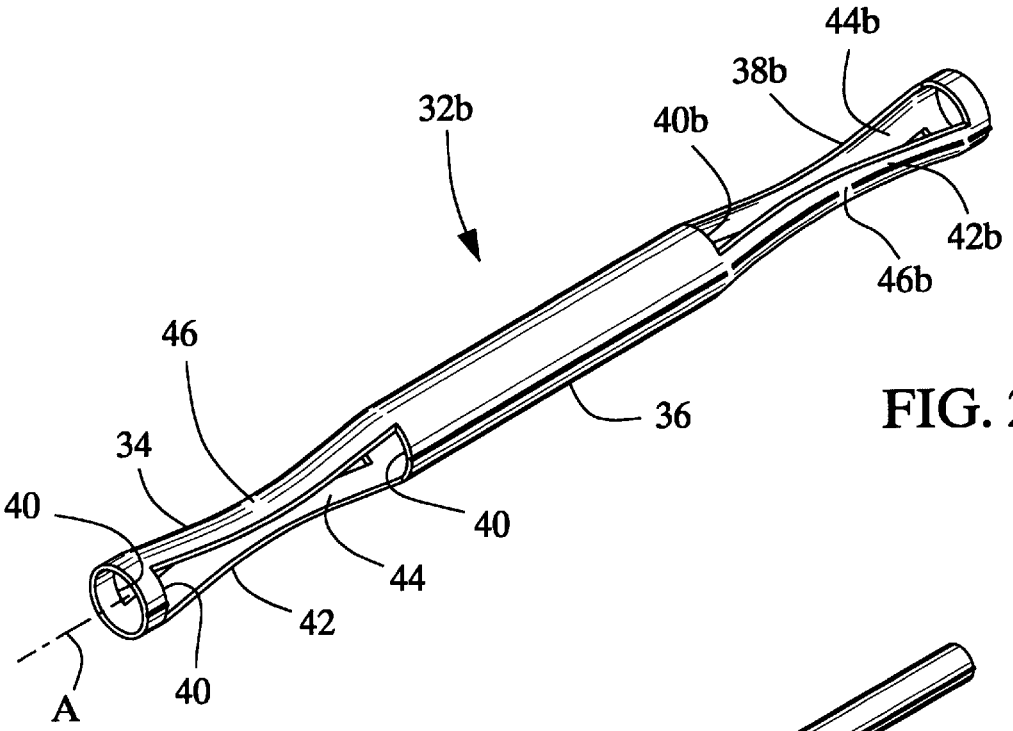
FIGS. 2 and 2*a* are perspective views of female-female and male-female type contact members of the present invention of respective FIGS. 1 and 1*a,* FIG. 2 also shows a variation of the first embodiment of FIG. 1 with the two ends axially rotated 90 degrees with respect to each other.

FIG. 2 shows a variation of the first embodiment of the cylindrical contact member 32*b* similar of FIG. 1. The longitudinal contact member 32*b* is symetrical along the axis A and is mainly composed of a first 34 and a second 38*b* substantially tubular and rigid, preferably continuous and not slotted, ends with a central section 36 therebetween. The first end 34 is adapted to be axially slidably engaged by a center conductor W and includes preferably two equally spaced, radially opposed and axially elongated, along axis A, continuous beams 42 forming two adjacent equally spaced, radially opposed and generally hourglass shape holes 40 therebetween (The holes 40 were generally rectangular before camber forming of the beams 42). The beams 42 are substantially symmetrically, radially, and inwardly cambered towards the axis A to define apex contact regions 46, and have concave inner surfaces 44 adapted to receive a wide variety of wire diameters. The tubular first end 34 of the contact member 32*a* preferably sealably engages and abuts the bore of the hole 31 of the small diameter section 30 of the insulating sleeve 26 (FIG. 1*a*). Similarly, the larger diameter of the central section 36 preferably sealably engages and abuts the smaller diameter section 30*a* at the through hole 31*a* of the insulating sleeve 26*a*.

The central section 36 between the first and second ends 34 and 38*b* respectively of the contact member 32*b* is preferably solid, but could also be hollowed. The second end 38*b* is also adapted to be axially slidably engaged by another center conductor W and includes two equally spaced, radially opposed and axially elongated, along axis A, continuous beams 42*b* forming two adjacent equally spaced, radially opposed hourglass shape holed 40*b* therebetween. The beams 42*b* are substantially symmetrically, radially, inwardly cambered towards the axis A to define apex contact regions 46*b,* and have concave inner surfaces 44*b* adapted to receive a wide variety of wire diameters. The tubular second end 38*b* of the contact member 32*b* preferably sealably engages and abuts the bore of the hole 31 of the second end 23 of the electrical connector 20 (FIG. 1). The first and second beams 42 and 42*b* of that variation of the first embodiment are axially rotated 90 degrees with respect to each other.

Figure 2A:
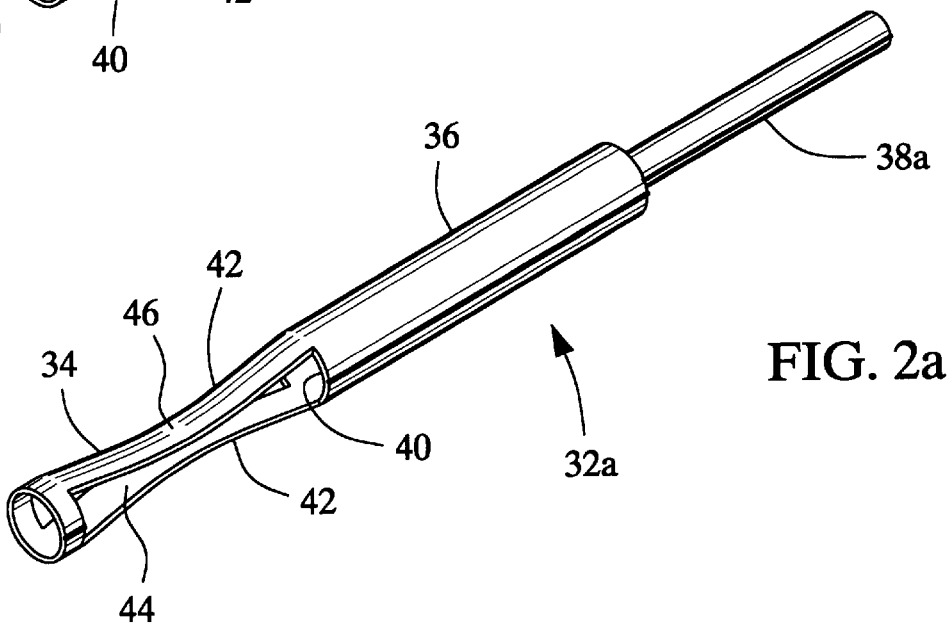

FIG. 2*a* shows the second embodiment of the contact member 32*a* where the second end 38*a* is of a substantially cylindrical pin shape with a diameter smaller than the central section 36.

Figure 3:
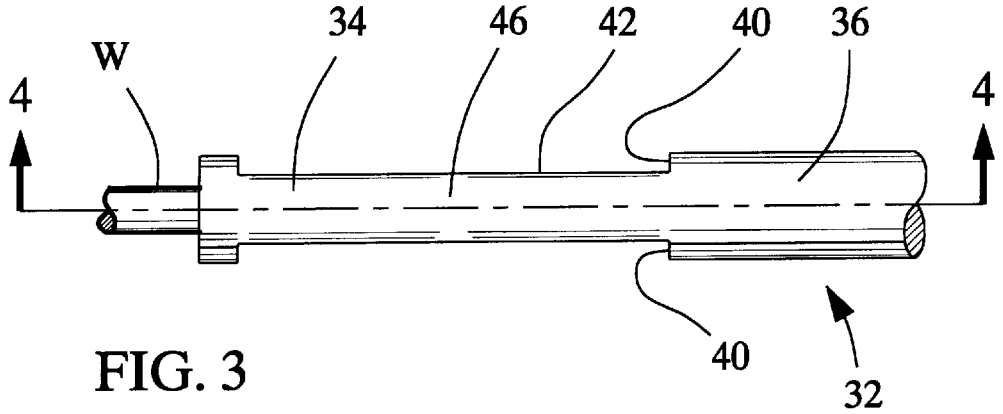
FIG. 3 is top view of a first end of the present invention with a center conductor inserted into the contact member of FIG. 2.
Figure 4:
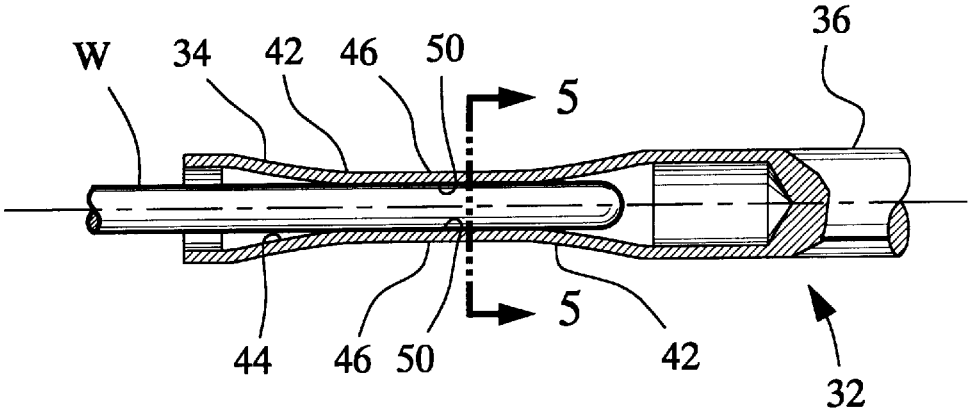
FIG. 4 is a section taken along the line 4—4 of FIG. 3.
Figure 5:
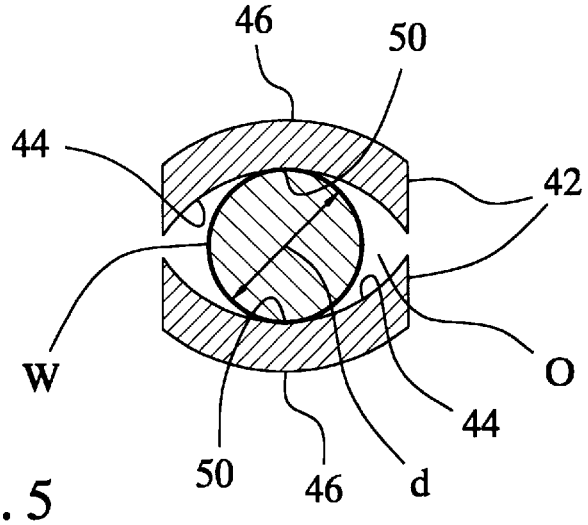
FIG. 5 is an enlarged section view taken along the line 5—5 of FIG. 4.

FIGS. 3 and 4 show the first end 34 of the contact member 32 when the center conductor W of diameter d is inserted inside the opening O (shown on FIG. 5) of the first end 34 of the contact member 32. A radial spring action is created by the inwardly cambered shape of resilient beams 42 when the center conductor W pushes the latter radially away from each other, substantially around the apex contact regions 46. Thus beams 42 flatten out to create substantially axial linear contacts so between the center conductor W and the inner surfaces 44 of the beams 42 at the respective contact region 46. The linear contacts 50 help create an efficient electrical contact zone to decrease as much as possible the electrical contact impedance and the associated return loss. The radial spring effect of the resilient beams 42 forms the partially closed opening O, as shown on FIG. 5, adapted to be enlarged upon axial insertion of the center conductor W therein. As seen on FIG. 5, the opening O is preferably of substantially elliptical shape for better axial alignment of the center conductor W within the contact member 32.

Although embodiments have been described herein with some particularity and details, many modifications and variations of the preferred embodiments are possible without deviating from the scope of the present invention.

I claim:

1. An electrical connector comprising:

a main body made out of an electrically conductive material and having an inner passage therethrough;

a pair of insulating sleeves fitted inside said inner passage, an outer end face of each insulating sleeve include a small diameter section; and a cylindrical contact member made out of an electrically conductive material and being fitted between said small diameter sections of said insulating sleeves, said cylindrical contact member having a first and second ends with a central section therebetween, said first end of said contact member is substantially tubular and is adapted to be axially slidably engaged by a center conductor, said first end includes two equally spaced radially opposed and axially elongated continuous beams forming two adjacent equally spaced radially opposed holes therebetween, each of said beams having a concave inner surface and being substantially symmetrically, radially, inwardly cambered towards the axis of said contact member to define an apex contact region, both of said contact regions forming an axially transverse and partially closed opening defined by both of said inner surfaces to receive said center conductor, each of said beams being resilient and adapted for biasing said center conductor against said contact region of the other of said beams, said beams being adapted to flatten out at said contact regions against said center conductor thereby providing axial linear contacts with the latter.

2. A connector as defined in claim 1, wherein said second end of said contact member is substantially tubular and is adapted to be axially slidably engaged by a second center conductor, said second end includes two second equally spaced radially opposed and axially elongated continuous beams forming two adjacent second equally spaced radially opposed holes therebetween, each of said second beams having a second concave inner surface and being substantially symmetrically, radially, inwardly cambered towards the axis of said contact member to define a second apex contact region, both of said second contact regions forming an axially transverse and partially closed second opening defined by both of said second inner surfaces to receive said second center conductor, each of said second beams being resilient and adapted for biasing said second center conductor against said second contact region of the other of said second beams, said second beams being adapted to flatten out at said second contact regions against said second center conductor thereby providing second axial linear contacts with the latter.

3. A connector as defined in claim 1, wherein said second end of said contact member is of substantially cylindrical shape, said second end of said contact member having a diameter smaller than said central section of said contact member.

4. A connector as defined in claim 1, wherein each of said smaller diameter sections of said insulating sleeves includes a bore hole adapted to sealably receive one of said ends of said contact member.

5. A connector as defined in claim 2, wherein said first and second ends of said contact member have their respective beams axially aligned with respect to each other.

6. A connector as defined in claim 2, wherein said first and second ends of said contact member have their respective beams axially rotated 90 degrees with respect to each other.

7. A connector as defined in claim 2, wherein said central section is substantially cylindrical and solid.

8. A connector as defined in claim 2, wherein said central section is substantially cylindrical and hollowed.

9. A connector as defined in claim 3, wherein said central section is substantially cylindrical and solid.

10. A connector as defined in claim 3, wherein said central section is substantially cylindrical and hollowed.

* * * * *